US007364408B2

(12) United States Patent
Skinner et al.

(10) Patent No.: US 7,364,408 B2
(45) Date of Patent: Apr. 29, 2008

(54) CRANK CASE SHUT OFF VALVE

(75) Inventors: Timothy Joseph Skinner, East Amherst, NY (US); Joseph M. Bona, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 581 days.

(21) Appl. No.: 10/846,066

(22) Filed: May 14, 2004

(65) Prior Publication Data

US 2004/0234383 A1 Nov. 25, 2004

Related U.S. Application Data

(60) Provisional application No. 60/471,876, filed on May 20, 2003.

(51) Int. Cl.
*F04B 1/26* (2006.01)
*F04B 1/12* (2006.01)

(52) U.S. Cl. ..... 417/222.2; 417/222.1; 417/269; 417/270

(58) Field of Classification Search ..... 417/222.2, 417/222.1, 269, 270
See application file for complete search history.

(56) References Cited

U.S. PATENT DOCUMENTS 4,752,189 A 6/1988 Bearint ..... 417/222
5,318,410 A 6/1994 Kawamura et al. ..... 417/222.2
6,074,173 A 6/2000 Taguchi ..... 417/222.2
6,099,276 A 8/2000 Taguchi ..... 417/569
6,267,562 B1 7/2001 Hirota ..... 417/222.2
6,334,759 B1 * 1/2002 Kaneko et al. ..... 417/222.2
6,374,625 B1 * 4/2002 Fujii et al. ..... 62/228.3
6,540,488 B2 4/2003 Takai et al. ..... 417/222.2
2002/0069657 A1 * 6/2002 Fujii et al. ..... 62/228.3
2003/0044291 A1 * 3/2003 Umemura et al. ..... 417/222.2
2003/0086791 A1 * 5/2003 Breindel et al. ..... 417/222.2

* cited by examiner

*Primary Examiner*—Devon C. Kramer
*Assistant Examiner*—Jessica L Frantz
(74) *Attorney, Agent, or Firm*—Patrick M. Griffin

(57) ABSTRACT

The invention provides a compressor with a shut off valve disposed between the crank case and the suction cavity. The valve is moveable between an open and closed position in response to the pressure in the discharge cavity of the compressor. The valve is an on/off valve and is operable rapidly depressurize the interior of the crank case when the compressor transitions from a minimum stroke. The valve can define first and second fluid pathways. The first fluid pathway can be larger than the second fluid pathway and be selectively opened and closed. The second fluid pathway can be permanently open and act as a bleed between the crank case and the suction cavity.

19 Claims, 6 Drawing Sheets

CRANK CASE SHUT OFF VALVE

CROSS-REFERENCE TO RELATED APPLICATIONS

This application claims the benefit of the provisional patent application 60/471,876 for a CRANK CASE SHUT OFF VALVE, filed on May 20, 2003, which is hereby incorporated by reference in its entirety. This claim is made under 35 U.S.C. §119(e); 37 C.F.R. § 1.78; and 65 Fed. Reg. 50093.

TECHNICAL FIELD

The invention provides a compressor for the climate control system of a vehicle and, more specifically, the invention provides a valve for controlling the flow of refrigerant between a crank case of the compressor and a suction cavity of the compressor, or discharge and crank case cavity to rapidly depressurize or re-pressurize the crank case.

BACKGROUND OF THE INVENTION

Variable displacement compressors have been applied to climate control systems for vehicles and were introduced with pneumatic or mechanical control hardware. With the advancement of electronic technologies, solenoids have commonly been used to increase the compressor control range. With the refinement of electronic control valves, compressor clutches are being eliminated. This type of compressor is commonly called a clutchless compressor and is usually an electronically controlled, variable displacement compressor.

The clutchless compressor cannot disengage or re-engage the clutch, hence the compressor is operational whenever the vehicle engine is running. When the climate control system is turned off, the compressor is placed at a minimum displacement. Ideally, the minimum displacement would be zero, but current compressor technology does not allow for such a device. Instead, the compressor must displace some refrigerant at minimum stroke.

Mainstream clutchless compressor technology utilizes a three-port electronic control valve in conjunction with a fixed orifice bleed to determine compressor displacement. In one known method, the electronic control valve regulates the flow of discharge gas to the compressor crank case and the fixed orifice bleed flows refrigerant from the crank case to the suction cavity in a rear head of the compressor. In a second method, the electronic control valve regulates the flow of refrigerant from the compressor crank case to the suction cavity and a fixed orifice bleed defines a pathway for refrigerant to flow from the discharge cavity in the rear head of the compressor to the crank case.

SUMMARY OF THE INVENTION

The present invention provides a climate control system having a compressor with a fluid pathway extending between a cavity defined by a crank case and a suction cavity and a valve operable to open and close the fluid pathway in response to pressure in a discharge cavity. The valve can include a housing, a piston moveably positioned in the housing between open and closed positions, and a spring to bias the piston to a closed position. The piston can define a surface in communication with the discharge cavity. Fluid in the discharge cavity can direct pressure against the surface defined by the piston and move the piston from the closed position to the open position. The housing and the piston can define a portion of the fluid pathway extending between the crank case and the suction cavity. The housing can also define a second fluid pathway between the crank case and the suction cavity that is permanently open. The valve of the present invention can also control flow from the discharge cavity to the cavity defined by the crank case.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
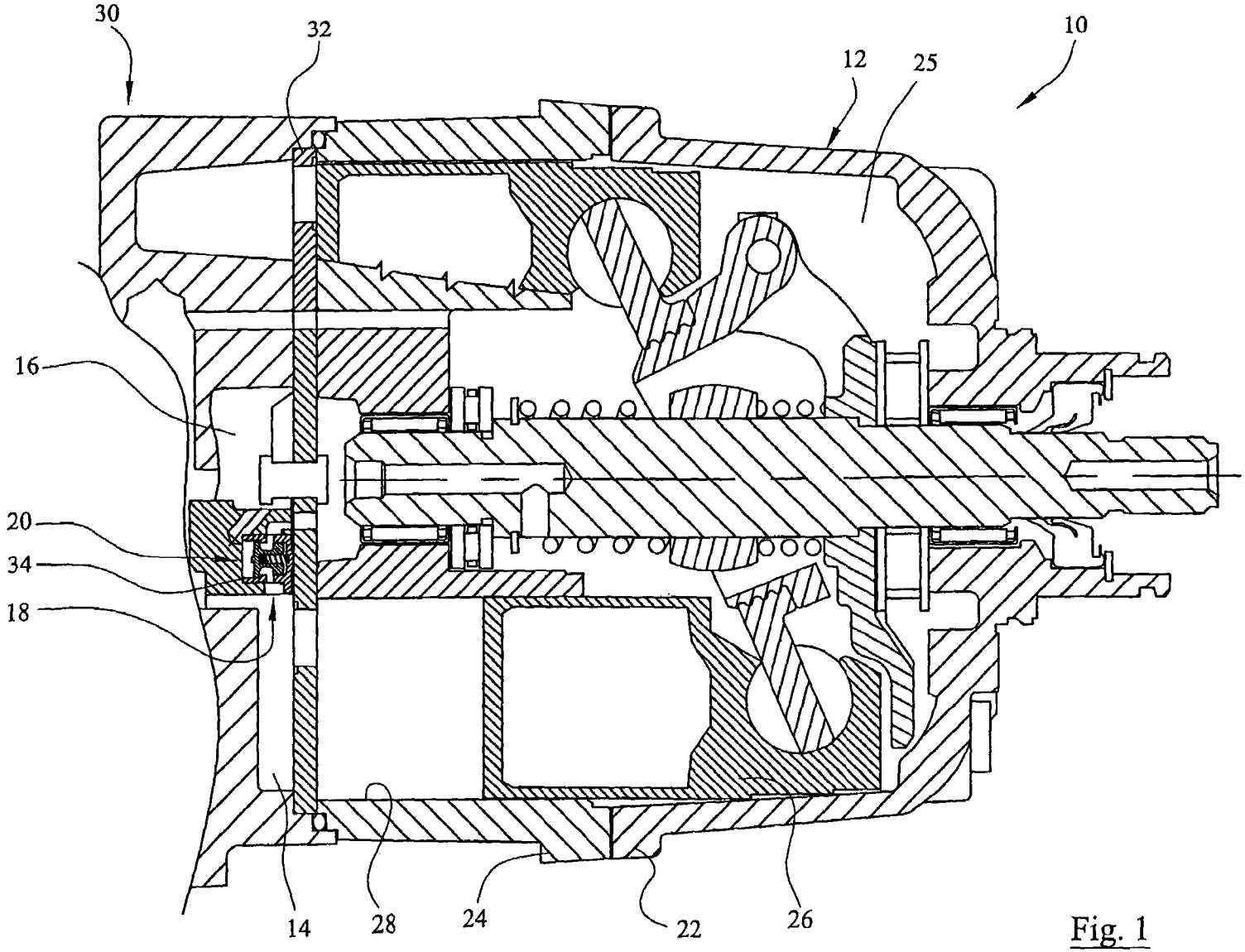
FIG. 1 is a cross-sectional view of the compressor according to the exemplary embodiment of the invention.

Referring now to FIG. 1, the present invention provides a compressor 10 for a climate control system of a vehicle. The compressor 10 includes a crank case 12, suction cavity 14, and a discharge cavity 16. The invention also includes a first fluid pathway 18 extending between the crank case 12 and the suction cavity 14. A valve 20 is positioned along the first fluid pathway 18 and is operable to open and close the first fluid pathway 18 in response to a fluid pressure in the discharge cavity 16.

In the exemplary embodiment of the invention, the crank case 12 includes a first portion 22 and a second portion 24 operably associated with one another to define a crank case interior 25. As used herein, the crank case 12 and the crank case interior 25 are generally redundant, both terms referring to essentially the same structure and having the same purpose. The crank case 12 houses at least one piston 26 moveable in a cylinder 28. The cylinder 28 communicates with the suction cavity 14 and the discharge cavity 16. In particular, fluid such as refrigerant is drawn into the cylinder 28 from the suction cavity 14 during an upstroke of the piston 26. Fluid is discharged into the discharge cavity 16 from the cylinder 28 during a downward stroke of the piston 26. The pressure of the fluid is increased during movement from the suction cavity 14 to the discharge cavity 16 through the cylinder 28.

A rear head 30 can be connected to the crank case 12 and a valve plate 32 can be positioned between the rear head 30 and the crank case 12. The rear head can define the suction cavity 14 and the discharge cavity 16. The valve 20 can be disposed in an aperture 34 defined by the rear head 30.

Figure 2:
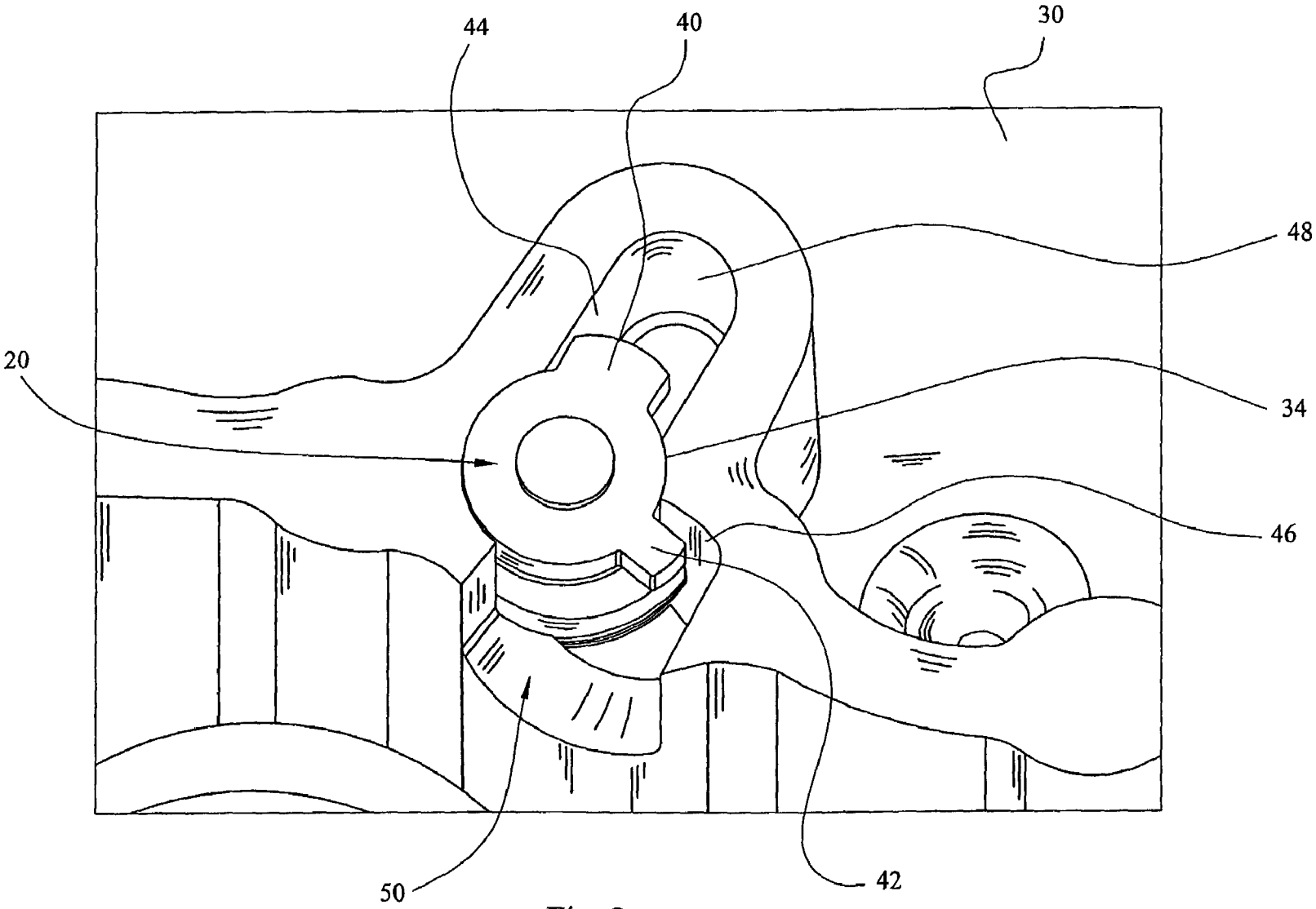
FIG. 2 is a perspective view showing the valve positioned in a rear head of the compressor shown in FIG. 1.
Figure 3:
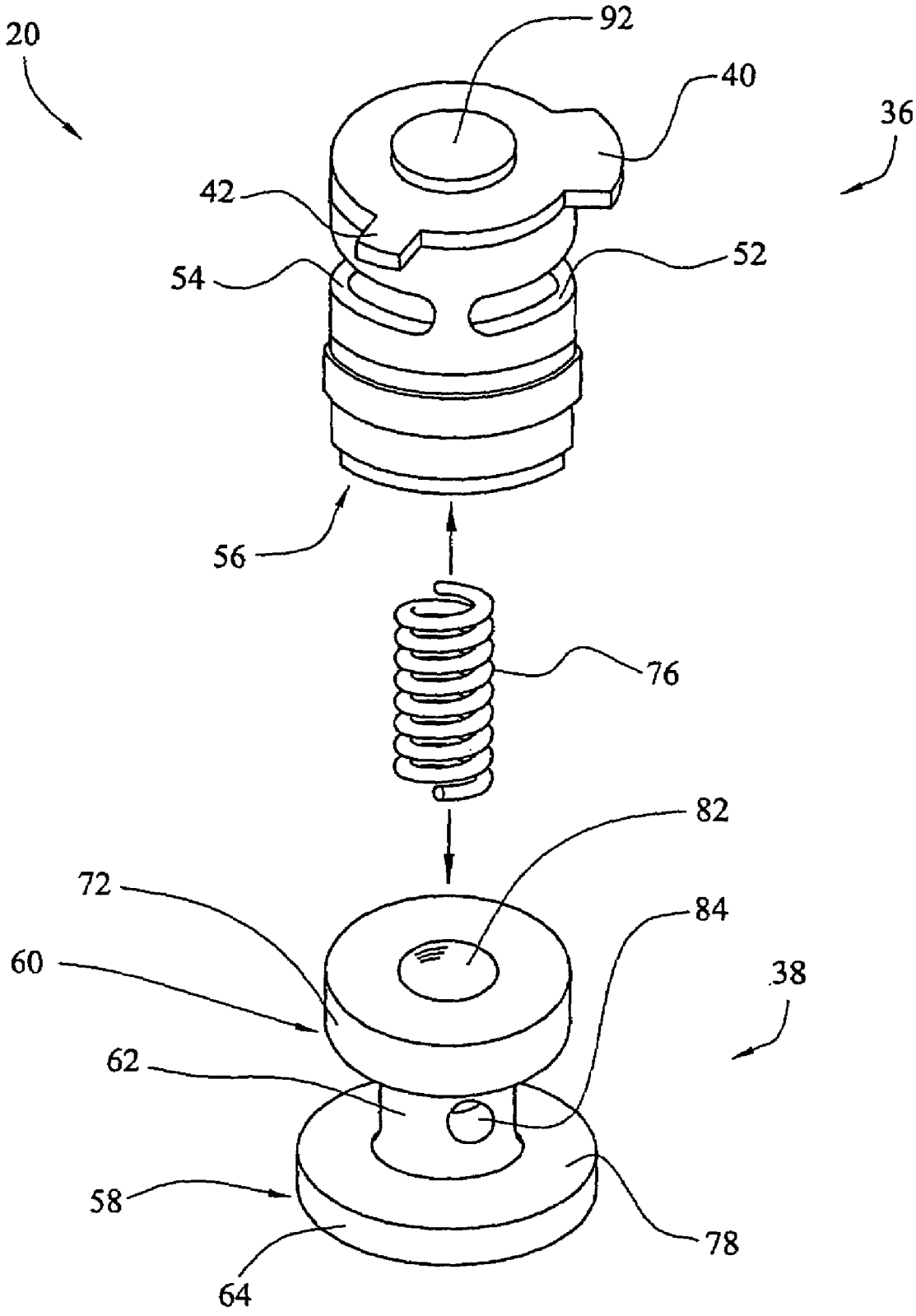
FIG. 3 is an exploded view of the valve shown in FIGS. 1 and 2.

Refeffing now to FIGS. 2 and 3, the valve 20 can include a housing 36 and a piston 38 moveably positioned in the housing 36. The housing 36 can be received in the aperture 34 of the rear head 30. The housing 36 can define one or more projections, such as tabs 40, 42, that cooperate with surfaces 44, 46, respectively, defined by the rear head 30 to orient the housing 36 as desired. The housing 36 can be positioned between the valve plate 32 and a bottom surface 70 of the aperture 34 such that the housing 36 is maintained longitudinally in a desired position. The bottom surface 70 of the aperture 34 is thus part of the discharge cavity 16.

The interior of the crank case 12 (shown in FIG. 1) can communicate with a well 48 defined by the rear head 30. The well 48 communicates with the aperture 34. The suction cavity 14 (shown in FIG. 1) can communicate with an opening 50 defined by the rear head 30. The valve 20 is positioned between the well 48 and the opening 50.

Figure 4:
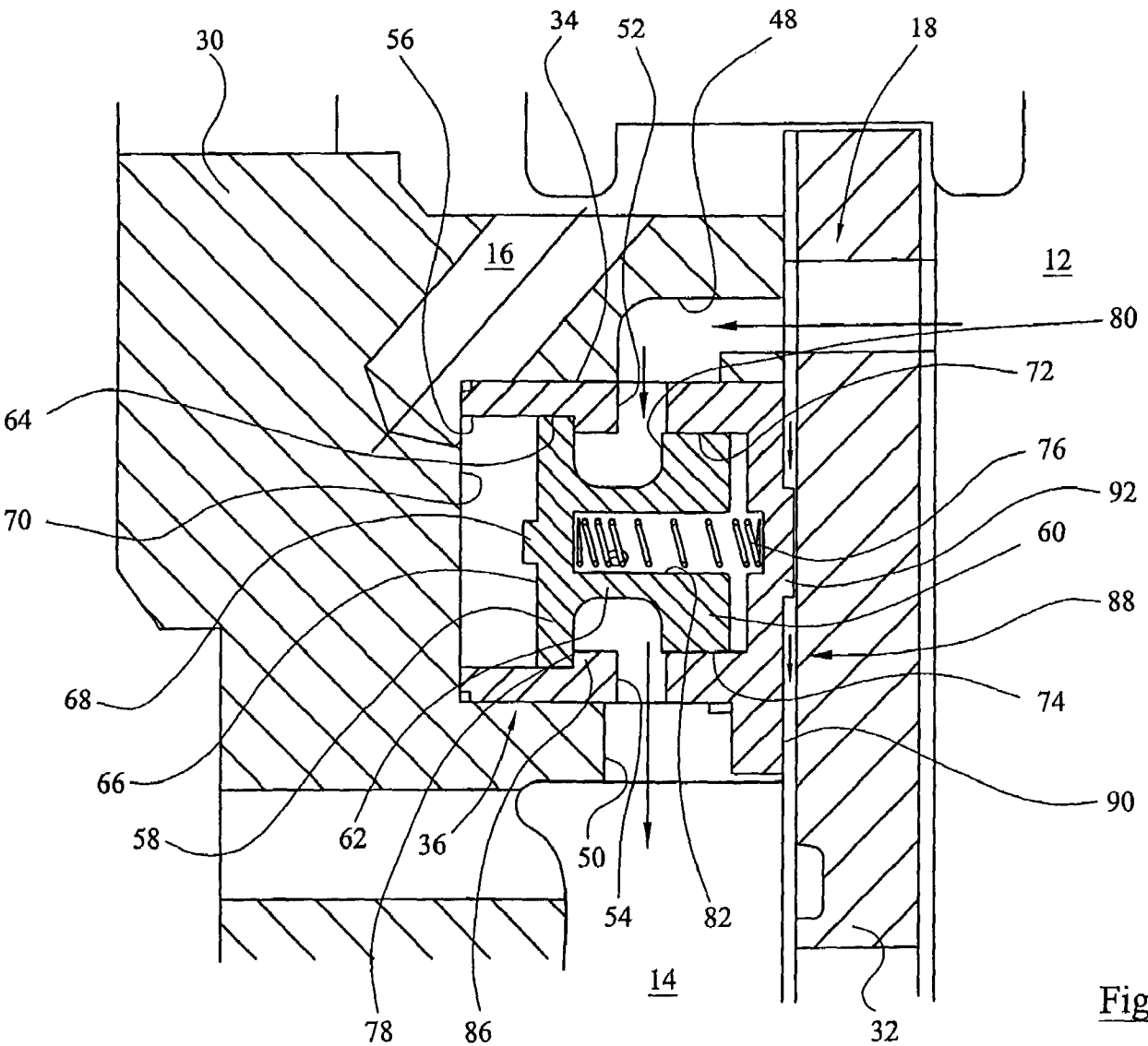
FIG. 4 is a cross-sectional view of the valve shown in FIGS. 1-3 in the open position.
Figure 5:
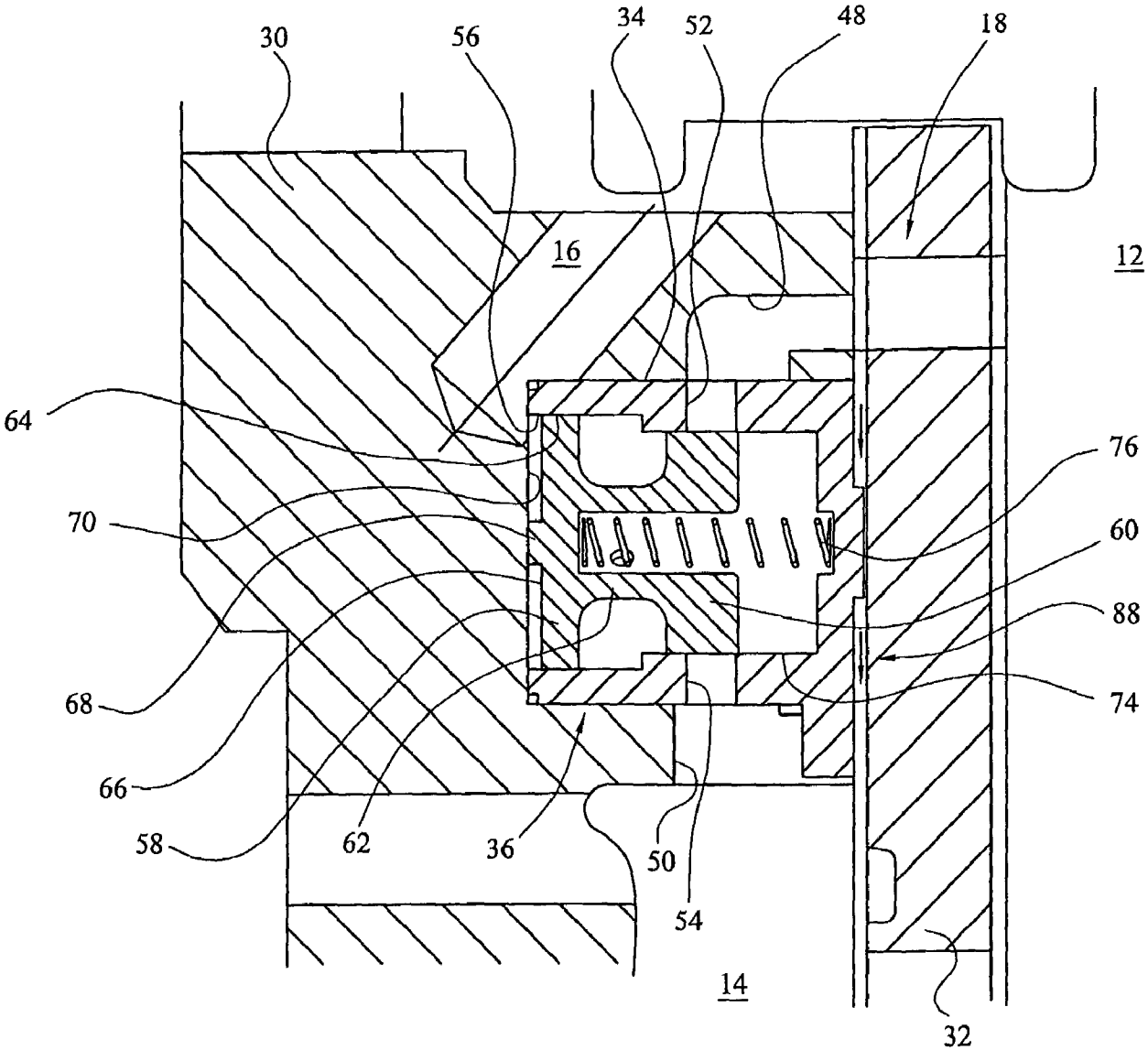
FIG. 5 is a cross-sectional view of the valve shown in FIGS. 1-4 in the closed position.

Refeffing now to FIGS. 2-4, the piston 38 is moveably positioned within the housing 36 between an open position, shown in FIG. 4, and a closed position, shown in FIG. 5. The piston 38 and housing 36 cooperate to open and close the fluid pathway 18. The housing 36 defines first and second apertures 52, 54, respectively. The apertures 52, 54 extend transverse to the housing 36 and define a portion of the fluid line 18. As shown in the perspective view of FIG. 3, the apertures 52, 54 extend partially annularly around the housing body 36. In the exemplary embodiment of the invention, the first fluid pathway 18 extends between the crank case 12 and the suction cavity 14 and is defined by the well 48, first aperture 52, the second aperture 54, and the opening 50.

The piston 38 includes a first head 58 defining an outer surface 64, a second head 60 defining an outer surface 72, and a neck 62 disposed between the first head 58 and the second head 60. When the piston 38 is in the closed position, the second head 60 closes the apertures 52, 54. When the piston 38 is in the open position, the fluid pathway is also defined, in part by an inner surface 78 of the first head 58, an inner surface 80 of the second head 60 and the neck 62, fluid moving around the neck 62 between the apertures 52, 54.

The housing 36 also defines a third aperture 56 communicating with the discharge cavity 16. The third aperture 56 is transverse to the first and second apertures 52, 54. A surface 66 of the piston 38 is open to the discharge cavity 16; fluid in the discharge cavity 16 can apply a pressure to the surface 66. The surface 64 of the first head 58 slidably cooperates with the aperture 56. The surface 72 of second head 60 slidably cooperates with the a reduced portion 74 of the aperture 56. A projection 68 extends from the surface 66 to engage the surface 70 when the piston 38 is in the closed position. The cooperation between the projection 68 and the surface 70 ensures that a space or gap is defined between the surface 66 and the surface 70 for pressurized fluid to enter the aperture 56 and act on the surface.

In the exemplary embodiment of the invention, a spring 76 is positioned between the housing and the piston 38 to bias the piston 38 to the closed position. The housing 36 and the piston 38 cooperate to define a spring chamber 82 in which the spring 76 is positioned. The neck 62 defines an aperture 84 communicating with the spring chamber 82. When the piston 38 is in the open or closed position, the aperture 84 communicates fluid from the fluid pathway 18 to the spring chamber 82. As a result, the pressure in the spring chamber 82 is the pressure in the suction cavity 14 and is less than the pressure in the discharge cavity 16. Also, the spring 76 and surfaces defining the spring chamber 82 can be lubricated by the fluid flowing along the pathway (18). The spring rate of the spring 76 is minimal; the valve 20 opens substantially as soon as the stroke of the piston 26 increases from a minimum stroke.

When the pressure in the discharge cavity 16 increases, corresponding to a stroke of the piston 26 greater than minimum stroke, the piston 38 moves to the open position. Also, the inner surface 78 of the first head 58 engages and seals against a shoulder 86 defined by the housing 36, sealing the fluid pathway 18 from the discharge cavity 16. The open fluid pathway 18 allows for rapid depressurization of the crank 12. As can be seen by FIGS. 4 and 5, the aperture 54 is oriented relative to the suction cavity 14 such that any force resulting from vacuum will act on the piston 38 in direction that is not the direction of movement of the piston 38. In other words, a suction force originating in the suction cavity 14 will act on the side of the piston 38 and will not urge the piston 38 to move away from the aperture 54 and thereby unblock the aperture 54.

The valve 20 also defines a second fluid pathway 88 extending between the crank case 12 and the suction cavity 14. The pathway 88 extends between a surface 90 of the housing 36 and the valve plate 32 and further bounded by a gasket disposed between the valve plate 32 and the rear head 30. The gasket is not shown to enhance the clarity of the drawings. A projection 92 can extend from the surface 90 and engage the valve plate 32. The cooperation between the projection 92 and the valve plate 32 ensures that a space or gap is defined between the surface 90 and the valve plate 32 for fluid to move between the crank case 12 and the suction cavity 14. The projection 92 can be sized such that the second fluid pathway 88 communicates less fluid between the crank case 12 and the suction cavity 14 than a 1.6 millimeter bleed valve that has been previously used in compressors.

Figure 6:
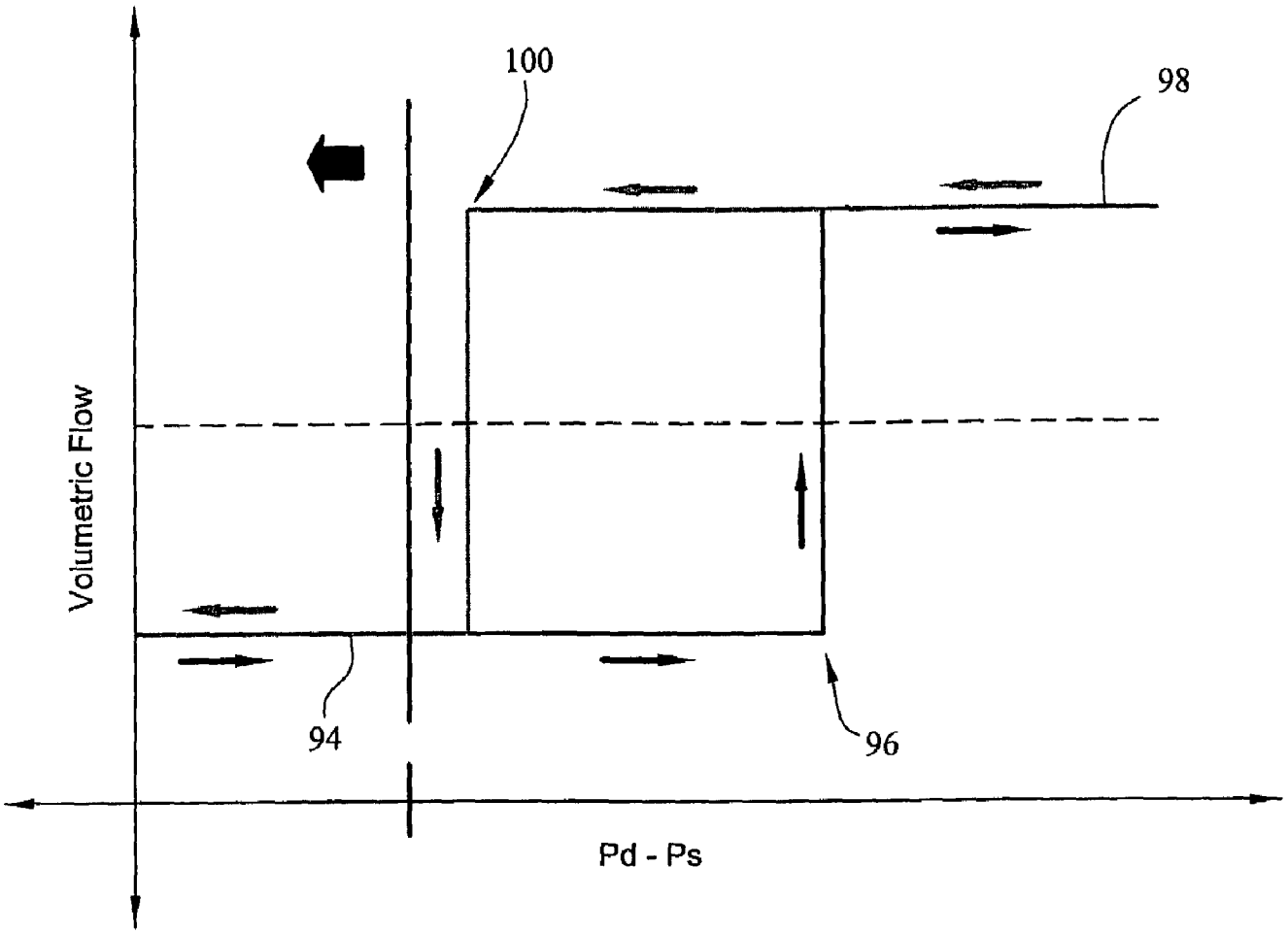
FIG. 6 is a graph illustrating the operation of the valve as a difference in pressure between the discharge cavity and the suction cavity increases.

The graph in FIG. 6 illustrates volumetric flow of fluid from the crank case 12 to the suction cavity along the y-axis and the difference in pressure between the discharge cavity 16 and the suction cavity 14 along the x-axis. The dashed line represents flow through a 1.6 millimeter bleed valve, previously used in compressors. A line portion 94 extends parallel to the x-axis from the y-axis to a point 96. The line 94 represents fluid flow between the crank case 12 and the suction cavity 14 through the second fluid pathway 88 while the piston 38 is in the closed position. The fluid flow represented by line 94 is less than the flow through a conventional 1.6 millimeter bleed. At point 96, the pressure in the discharge cavity 16 urges the piston 38 to the open position and volumetric flow between the crank case 12 and the suction cavity 14 increases to a second line portion 98 and the crank case 12 is quickly depressurized. Thus, in operation, the valve opens when a pressure differential between the discharge cavity and the suction cavity is at a first level and closes when the pressure differential between the discharge cavity and the suction cavity is at a second level less than the first level.

As the compressor 10 is position to a minimum stoke, the difference in pressure between the discharge cavity 16 and the suction cavity 14 decreases and the operation of the compressor 10 is represented by point 100 along the line portion 98. At point 100, the piston 38 moves to the closed position and volumetric flow between the crank case 12 and the suction cavity 14 decreases to line portion 94.

In operation, the compressor 10 according to the present invention provides numerous benefits and advantages over prior compressors. When the piston 38 is in the closed position, volumetric flow between the crank case 12 and the suction cavity 14 is reduced since the second fluid pathway 88 is smaller than a convention 1.6 millimeter bleed. As a result, the pressure in the crank case 12 will increase faster and the minimum displacement of the piston 36 will decrease. Furthermore, the reduced minimum displacement of the piston 36 will result in reduced power consumption, less wear, reduced torque fluctuations, and reduced likelihood of evaporator freeze. When the piston 38 is in the open position, volumetric flow between the crank case 12 and the suction cavity 14 is increased since the first and second fluid pathways 18, 88 are collectively larger than a convention 1.6 millimeter bleed. As a result, the transition from minimum piston stroke will be enhanced under all operating conditions.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A climate control system for a vehicle comprising:
a compressor having a crankcase and a suction cavity and discharge cavity;
a first fluid pathway extending between said crankcase and said suction cavity; and
a valve positioned along said first fluid pathway to open and close said first fluid pathway such that fluid pressure in said first fluid path way does not act in the opening and closing direction of said valve, and said valve opens only in response to a net increase of fluid pressure in said discharge cavity acting on said valve.

2. The climate control system of claim 1 including a second fluid pathway defined at least partially by said valve and placing said crankcase and said suction cavity in fluid communication with one another.

3. A climate control system for a vehicle comprising:
a compressor having a crankcase and a suction cavity and discharge cavity;
a first fluid pathway extending between said crankcase and said suction cavity; and
a valve positioned along said first fluid pathway to open and close said first fluid pathway such that fluid pressure in said first fluid pathway does not act in the opening and closing direction of said valve, and said valve opens only in response to a net increase of fluid pressure in said discharge cavity acting on said valve;
wherein said valve includes a surface communicating with said discharge cavity and a projection extending from said surface and contacting said discharge cavity when said valve is closed and spaced from said discharge cavity when said valve is open, said projection ensuring a gap exists between said surface and said discharge cavity.

4. The climate control system of claim 3 wherein said valve includes:
a housing with first and second apertures on opposite sides of said housing wherein a fluid can pass through said first and second apertures between said crankcase and said suction cavity; and
a piston moveably positioned in said housing between an open position wherein said piston blocks both of said first and second apertures and a closed position wherein said piston is spaced from both of said first and second apertures and said surface being defined by said piston.

5. The climate control system of claim 4 wherein at least one of said first and second apertures extends partially annularly around said housing.

6. The climate control system of claim 5 wherein said housing defines a third aperture communicating with said discharge cavity for communicating pressurized fluid to said surface of said piston, wherein said third aperture is transverse to said first and second apertures.

7. The climate control system of claim 6 wherein said housing defines an inner shoulder operable to cooperate with said piston to substantially isolate said first fluid pathway from said third aperture when said piston is in said open position.

8. The climate control system of claim 7 including a spring disposed between said housing and said piston wherein said spring urges said piston to said closed position.

9. The climate control system of claim 8 wherein said piston and said housing define a spring chamber and said spring being disposed in said spring chamber and said spring chamber being in fluid communication with said first fluid pathway when said piston is in said open position.

10. The climate control system of claim 4 wherein said piston defines a portion of the first fluid pathway.

11. The climate control system of claim 10 wherein said piston includes a first head and a second head and a neck disposed between said first and second head and wherein said first fluid pathway is constrained between said first head and said second head and extends around said neck portion.

12. A climate control system for a vehicle comprising:
a compressor having a crankcase and a suction cavity and discharge cavity;
a first fluid pathway extending between said crankcase and said suction cavity;
a valve positioned along said first fluid pathway to open and close said first fluid pathway such that fluid pressure in said first fluid pathway does not act in the opening and closing direction of said valve, and said valve opens only in response to a net increase of fluid pressure in said discharge cavity acting on valve; and
a second fluid pathway defined at least partially by said valve and placing said crankcase and said suction cavity in fluid communication with one another;
wherein the second fluid pathway is permanently open and extends around an outer surface of said valve.

13. A method for controlling a climate of a vehicle comprising the steps of:
defining a crankcase and a suction cavity and discharge cavity with a compressor;
extending a fluid pathway placing between the crankcase and the suction cavity;
positioning a valve along the first fluid pathway to open and close the first fluid pathway; and
selectively opening the valve and the first fluid pathway only in response to a net increase of fluid pressure in a discharge cavity acting on said valve to rapidly depressurize the crankcase, wherein fluid pressure in said first fluid pathway does not act in the opening and closing direction of said valve.

14. The method of claim 13 including stroking a piston in the crankcase a stroke length between a minimum stroke length and a maximum stoke length to discharge pressurized fluid to the discharge cavity and wherein said opening step is further defined as opening the valve in response to any increase in the stroke of the piston from the minimum stoke length.

15. The method of claim 14 including biasing the valve to the closed position with a spring and lubricating the valve with fluid moving along the first fluid pathway.

16. The method of claim 13 including placing the crankcase and the suction cavity in fluid communication with one another along a second fluid pathway defined at least in part by the valve.

17. A method for controlling a climate of a vehicle comprising the steps of:

defining a crankcase and a suction cavity and discharge cavity with a compressor;

extending a fluid pathway placing between the crankcase and the suction cavity;

positioning a valve along the first fluid pathway to open and close the first fluid pathway;

selectively opening the valve and the first fluid pathway only in response to a net increase of fluid pressure in a discharge cavity acting on said valve to rapidly depressurize the crankcase, wherein fluid pressure in said first fluid pathway does not act in the opening and closing direction of said valve;

placing the crankcase and the suction cavity in fluid communication with one another along a second fluid pathway defined at least in part by the valve; and maintaining the second fluid pathway in an open condition to facilitate continuous movement of fluid between the crankcase and the suction cavity.

18. The method of claim 17 including sizing the second fluid pathway smaller than the first fluid pathway.

19. A method for controlling a climate of a vehicle comprising the steps of:

defining a crankcase and a suction cavity and discharge cavity with a compressor;

extending a fluid pathway placing between the crankcase and the suction cavity;

positioning a valve along the first fluid pathway to open and close the first fluid pathway;

selectively opening the valve and the first fluid pathway only in response to a net increase of fluid pressure in a discharge cavity acting on said valve to rapidly depressurize the crankcase, wherein fluid pressure in said first fluid pathway does not act in the opening and closing direction of said valve;

opening the valve when a pressure differential between the discharge cavity and the suction cavity is at a first level; and closing the valve when the pressure differential between the discharge cavity and the suction cavity is at a second level less than the first level.

* * * * *